US010561281B1

(12) United States Patent
Lu et al.

(10) Patent No.: US 10,561,281 B1
(45) Date of Patent: Feb. 18, 2020

(54) CONVENIENT CONTROL DEVICE APPLIED TO ENERGY-SAVING SHOWER DEVICE

(71) Applicant: XIAMEN EASO CO., LTD., Xiamen, Fujian (CN)

(72) Inventors: Haitao Lu, Xiamen (CN); Yuebin Yang, Xiamen (CN); Zhen Li, Xiamen (CN); Ximin Chen, Xiamen (CN)

(73) Assignee: XIAMEN EASO CO., LTD., Xiamen, Fujian (CN)

( * ) Notice: Subject to any disclaimer, the term of this patent is extended or adjusted under 35 U.S.C. 154(b) by 0 days.

(21) Appl. No.: 16/147,894

(22) Filed: Oct. 1, 2018

(51) Int. Cl.
*A47K 3/28* (2006.01)

(52) U.S. Cl.
CPC ..... *A47K 3/28* (2013.01)

(58) Field of Classification Search
CPC ..... A47K 3/28
USPC ..... 4/612
See application file for complete search history.

(56) References Cited

U.S. PATENT DOCUMENTS 4,934,001 A * 6/1990 Landreth ..... A47K 3/285 4/615
5,277,454 A * 1/1994 Lorch ..... E03C 1/0401 239/587.1
5,937,451 A * 8/1999 Mihara ..... E03D 9/085 239/583
7,458,112 B1 * 12/2008 Yang ..... E03C 1/0408 137/625.47
2006/0218721 A1 * 10/2006 Ho ..... A61H 33/6036 4/615
2017/0002553 A1 * 1/2017 Huang ..... E03C 1/0408

* cited by examiner

*Primary Examiner* — Jeremy Carroll
(74) *Attorney, Agent, or Firm* — Chun-Ming Shih

(57) ABSTRACT

A convenient control device applied to an energy-saving shower device includes a shower rod, a water diverter, and an operating mechanism. The water diverter is connected to the upper end of the shower rod. The operating mechanism is connected to the lower end of the shower rod. The operating mechanism is linked with a valve core of the water diverter through a linking member located in the shower rod. The operating mechanism can control the water diverter to switch the waterway. It is convenient for users of different heights to switch different spray modes.

15 Claims, 5 Drawing Sheets

CONVENIENT CONTROL DEVICE APPLIED TO ENERGY-SAVING SHOWER DEVICE

BACKGROUND OF THE INVENTION

1. Field of the Invention

The present invention relates to a bathroom accessory, and more particularly to a convenient control device applied to an energy-saving shower device.

2. Description of the Prior Art

In general, a conventional household shower device includes a shower nozzle and a hand-held show head. Through a water diverter disposed at the water outlet of a water supply pipe, the shower nozzle and the hand-held show head are selective to spray water.

For the families in the Americas, the water outlet of the water supply pipe is located at the upper part of the wall. The wall is provided with a shower rod communicating with the water outlet of the water supply pipe as a water passage for the shower nozzle or the hand-held show head to spray water. The upper part of the shower rod is connected to the water outlet of the water supply pipe. The shower rod is provided with an adjustable bracket to retain the hand-held shower head for adjusting the height of the hand-held shower head to be retained. In general, the water diverter used for switching the waterway of the shower nozzle and the waterway of the hand-held shower head is disposed in the shower rod at a position corresponding to the water outlet of the water supply pipe. It is inconvenient for a user or child whose height is not tall enough to operate the water diverter, and there are limitations in use. Accordingly, the inventor of the present invention has devoted himself based on his many years of practical experiences to solve these problems.

SUMMARY OF THE INVENTION

The primary object of the present invention is to provide a convenient control device applied to an energy-saving shower device, which is suitable for a wall-mounted shower device and can facilitate users of different heights to switch spray modes.

In order to achieve the above object, the present invention adopts the following technical solutions.

A convenient control device applied to an energy-saving shower device comprises a shower rod, a water diverter, and an operating mechanism. The water diverter includes a three-way body and a valve core. The three-way body has a lateral inlet, an upper outlet, and a lower outlet. The valve core is movably fitted in the three-way body to block the upper outlet and the lower outlet. The shower rod is a hollow structure. An upper end of the shower rod is connected to the lower outlet of the three-way body. The operating mechanism includes a three-way member and an operating assembly. The three-way member has an inlet end opening, an outlet end opening, and a mounting end opening. The operating assembly is fitted in the mounting end opening. The inlet end opening is connected to a lower end of the shower rod. The operating assembly includes a lead screw assembly and a knob for driving the lead screw assembly to rotate. The lead screw assembly is linked with the water diverter through a linking member located in the shower rod.

Preferably, the lead screw assembly includes a lead screw and a lead screw sleeve. An outer wall of the lead screw sleeve and an inner wall of the mounting end opening are connected by a keyed joint connection. A first end of the lead screw sleeve is linked with the valve core through the linking member. A second end of the lead screw sleeve is threadedly connected to a first end of the lead screw. A second end of the lead screw is connected to the knob.

Preferably, the inlet end opening is located at a top of the three-way member. A side of the three-way member is formed with an inner cylinder and an outer cylinder surrounding the inner cylinder. The inner cylinder is formed with the mounting end opening. An outer end opening of the outer cylinder is connected with a mounting cover to cover the inner cylinder. The second end of the lead screw is inserted through the mounting cover and connected to the knob.

Preferably, the mounting cover is provided with a central through hole through which the lead screw passes. A side wall of the lead screw is matched with a retaining ring to engage an inner end edge of the through hole.

Preferably, a positioning mechanism is provided between the knob and the mounting cover. The positioning mechanism includes at least two recesses disposed on the mounting cover and an elastic pin disposed on the knob. The elastic pin is movably engaged with one of the recesses.

Preferably, the inner wall of the mounting end opening is provided with a limiting flange. The outer wall of the lead screw sleeve is provided with a stopping edge that is movably engaged with the limiting flange.

Preferably, a sealing member is provided between the stopping edge and the inner wall of the mounting end opening.

Preferably, the inner wall of the mounting end opening is provided with a limiting keyway, and the outer wall of the lead screw sleeve is provided with a limiting key which is inserted into the limiting keyway.

Preferably, the linking member includes a wire tube, a wire, and a reversing drive mechanism. The reversing drive mechanism includes a reversing swing block, a guide sleeve, a piston, a push rod, and a return spring. The guide sleeve is fitted in the inlet end opening. The piston is movably disposed in the guide sleeve. The reversing swing block is rotatably fitted under the guide sleeve. An upper end of the push rod is inserted into the guide sleeve from a lower end of the guide sleeve and connected to the piston. A lower end of the push rod is movable to hold one side of the reversing swing block. The first end of the lead screw sleeve is movable to hold another side of the reversing swing block. The lower end of the push rod is provided with a stopping piece extending outward. Two ends of the return spring lean against the lower end of the guide sleeve and an upper end surface of the stopping piece, respectively. The wire tube is fixed in the shower rod. A lower end of the wire tube is connected to an upper end of the guide sleeve. The wire is movably disposed in the wire tube. An upper end of the wire is connected to the valve core. A lower end of the wire is inserted in the guide sleeve from the upper end of the guide sleeve and connected to the piston.

Preferably, an upper end of the wire tube is connected with a fixing sleeve. An outer wall of the fixing sleeve is provided with a fixing flange connected to an inner wall of the shower rod. The fixing flange is formed with a water aperture. An outer wall of the guide sleeve is provided with an engaging member that is engaged with a circumferential edge of a lower end opening of the shower rod. The engaging member is provided with a water hole.

Preferably, the wire is a steel wire.

Preferably, the engaging member has a hinge portion extending downward, and the reversing swing block is hinged to the hinge portion.

Preferably, the valve core is a cylinder, and a lower end of the valve core is movably inserted into the fixing sleeve and connected to the upper end of the wire.

Preferably, the upper end and the lower end of the wire are provided with fixing blocks, respectively. The lower end of the valve core is provided with a first engaging groove for engaging the fixing block at the upper end of the wire. The piston is provided with a second engaging groove for engaging the fixing block at the lower end of the wire.

Preferably, a central portion of the valve core is provided with a limiting protrusion that is movably engaged with a circumferential edge of an upper end of the lower outlet.

With the above structure, by rotating the knob of the operating mechanism, the present invention can drive the valve core to move and block the upper outlet or the lower outlet through the lead screw assembly and the linking member, thereby switching the shower nozzle or the hand-held shower head to spray water. Since the operating mechanism is connected to the lower end of the shower rod, the present invention can facilitate the switching of spray mods for users of different heights.

DETAILED DESCRIPTION OF THE PREFERRED EMBODIMENTS

Figure 1:
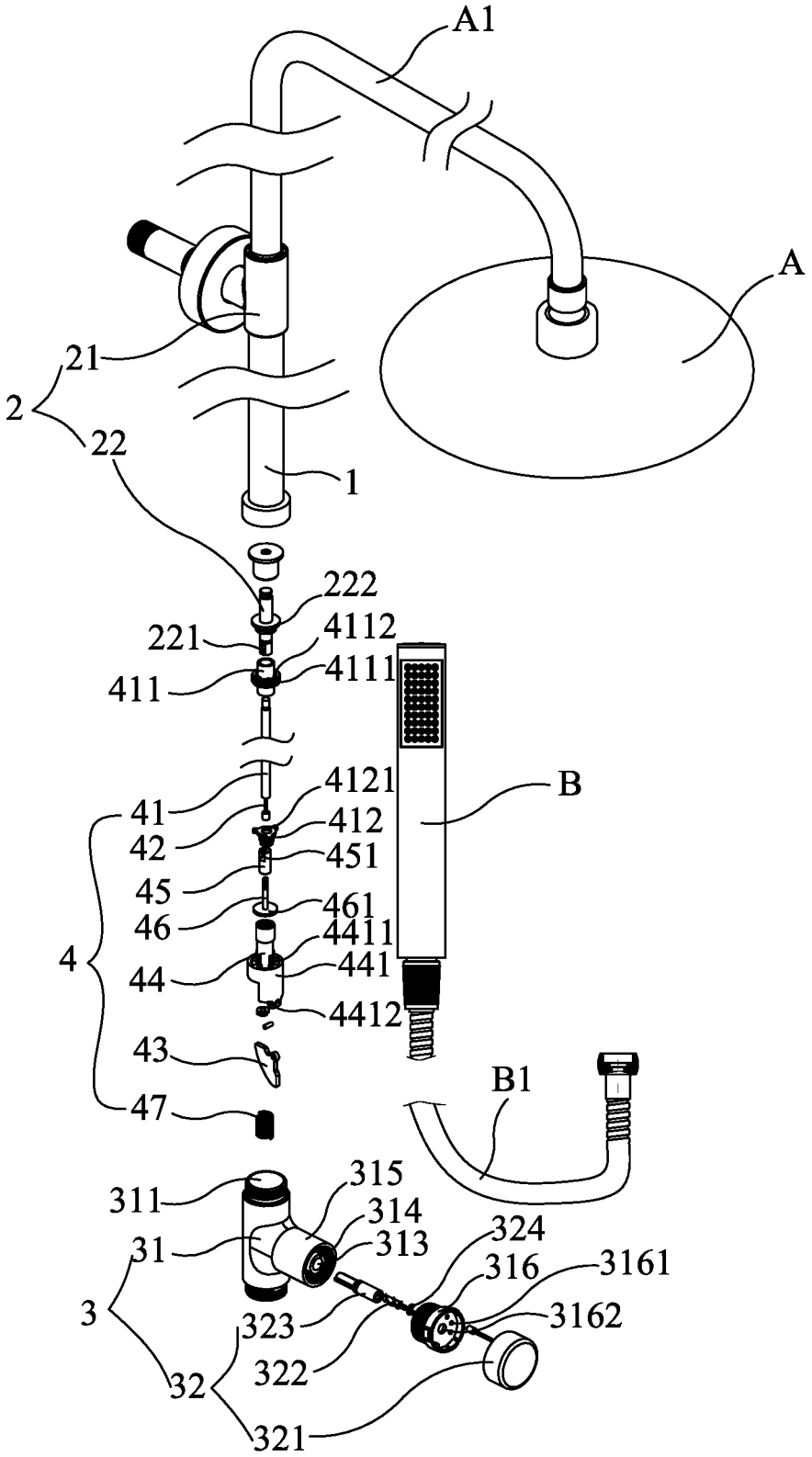
FIG. 1 is an exploded view of the present invention.

Embodiments of the present invention will now be described, by way of example only, with reference to the accompanying drawings.

As shown in FIG. 1 to FIG. 6, the present invention discloses a convenient control device applied to an energy-saving shower device, which is suitable for a wall-mounted shower device. The shower device comprises a shower nozzle A and a hand-held shower head B. The convenient control device comprises a shower rod 1, a water diverter 2, and an operating mechanism 3 for controlling the water diverter 2. The water diverter 2 includes a three-way body 21 and a valve core 22. The three-way body 21 has a lateral inlet 211, an upper outlet 212, and a lower outlet 213. The valve core 22 is movably fitted in the three-way body 21 and is movable to block the upper outlet 212 and the lower outlet 213. The lateral inlet 211 is connected to the water outlet of a water supply pipe (not shown). The upper outlet 212 is connected to the shower nozzle A through a curved pipe A1. The shower rod 1 is a hollow structure. An upper end of the shower rod 1 is connected to the lower outlet 213 of the three-way body 21 of the water diverter 2. A lower end of the shower rod 1 is connected to the operating mechanism 3. The operating mechanism 3 includes a three-way member 31 and an operating assembly 32. The three-way member 31 has an inlet end opening 311, an outlet end opening 312, and a mounting end opening 313. The operating assembly 32 is fitted in the mounting end opening 313. The inlet end opening 311 is connected to the lower end of the shower rod 1. The outlet end opening 312 is connected to the hand-held shower head B through a hose B 1. The operating assembly 32 includes a lead screw assembly fitted in the mounting end opening 313 and a knob 321 for driving the lead screw assembly to rotate. The lead screw assembly is linked with the water diverter 2 through a linking member 4 located in the shower rod 1. Thus, by rotating the knob 321, the water diverter 22 can be driven by the lead screw assembly and the linking member 4 to move, thereby switching the shower nozzle A or the hand-held shower head B to spray water.

Figure 2:
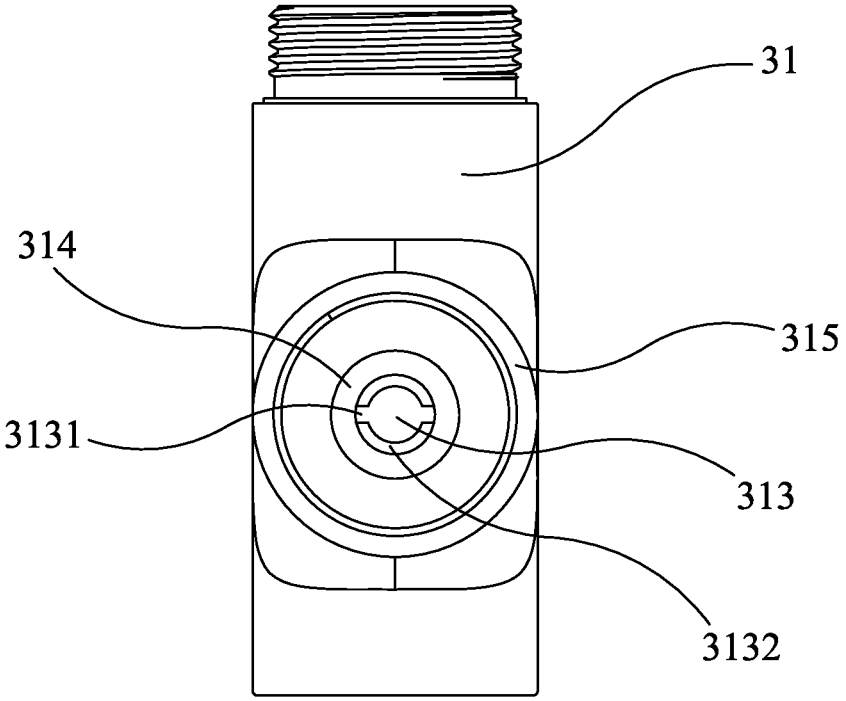
FIG. 2 is a structural schematic view of the lead screw sleeve of the present invention.

As shown in FIG. 1 and FIG. 2, the mounting end opening 313 is disposed at one side of the three-way member 31. Specifically, the inlet end opening 311 is located at the top of the three-way member 31. The side of the three-way member 31 is formed with an inner cylinder 314 and an outer cylinder 315 surrounding the inner cylinder 314. The inner cylinder 314 is formed with the mounting end opening 313. An outer end opening of the outer cylinder 315 is connected with a mounting cover 316 to cover the inner cylinder 314 by a screw connection. The mounting cover 316 is not limited to being connected to the outer end opening of the outer cylinder 315 by means of a screw connection. The mounting cover 316 may be connected to the outer end opening of the outer cylinder 315 by means of a snap-fit connection.

Figure 3:
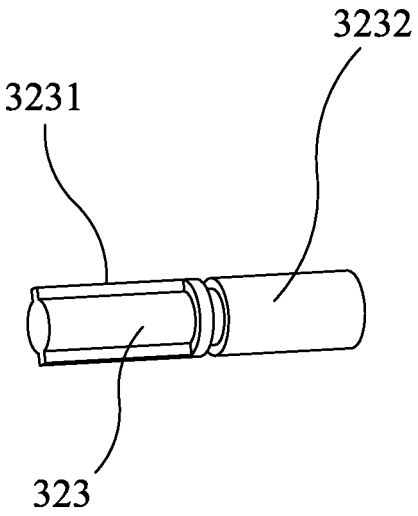
FIG. 3 is a structural schematic view of the three-way member of the present invention.

As shown in FIG. 1 and FIG. 3 to FIG. 6, the lead screw assembly includes a lead screw 322 and a lead screw sleeve 323. The outer wall of the lead screw sleeve 323 and the inner wall of the mounting end opening 313 are connected by a keyed joint connection to make the lead screw sleeve 323 to be circumferentially limited. One end of the lead screw sleeve 323 is linked with the valve core 22 through the linking member 4, and the other end of the lead screw sleeve 323 is threadedly connected to one end of the lead screw 322. The other end of the lead screw 322 is inserted through the mounting cover 316 and connected to the knob 321. In this way, when the knob 321 is rotated, the knob 321 can drive the lead screw 322 to rotate. Since the outer wall of the lead screw sleeve 323 and the inner wall of the mounting end opening 313 are connected by a keyed joint connection, the rotation of the lead screw 322 can drive the lead screw sleeve 323 to move toward the knob 321 or drive the lead screw sleeve 323 to move away from the knob 321. As shown in FIG. 1, the lead screw 322 and the knob 321 are connected by a keyed joint connection. The end of the lead screw 322 is provided with a spline 3221. The center of the knob 321 is provided with a spline groove 3211 corresponding to the spline 3221. As shown in FIG. 2 and FIG. 3, the inner wall of the mounting end opening 313 is provided with a limiting keyway 3131. The outer wall of the lead screw sleeve 323 is provided with a limiting key 3231 which is inserted into the limiting keyway 3131, so that the outer wall of the lead screw sleeve 323 and the inner wall of the mounting end opening 313 are connected by a keyed joint connection. As shown in FIG. 1 and FIG. 4 to FIG. 6, in order to facilitate the accurate rotation of the lead screw 322 through the knob 321, a positioning mechanism is provided between the knob 321 and the mounting cover 316. The positioning mechanism includes at least two recesses 3161 disposed on the mounting cover 316 and an elastic pin 3212 disposed on the knob 321. The elastic pin 3212 is movably engaged with one of the recesses 3161.

As shown in FIG. 1 and FIG. 3 to FIG. 6, in order to prevent the lead screw 322 from falling off the mounting end opening 313, the mounting cover 316 is provided with a central through hole 3162 through which the lead screw 322 passes. The side wall of the lead screw 322 is matched with a retaining ring 324 to engage an inner end edge of the through hole 3162 for limiting the lead screw 322. The retaining ring 324 is a C-shaped ring. The side wall of the lead screw 322 is provided with an annular groove 3222 for the C-shaped ring to be clamped. As shown in FIG. 3 to FIG. 6, in order to prevent the lead screw sleeve 323 and the lead screw 322 from being separated from each other, the inner wall of the mounting end opening 313 is provided with a limiting flange 3132. The outer wall of the lead screw sleeve 323 is provided with a stopping edge 3232 that is movably engaged with the limiting flange 3132. In order to prevent water from leaking from the mounting end opening 313, a sealing member a is provided between the stopping edge 3232 and the inner wall of the mounting end opening 313.

As shown in FIG. 1 and FIG. 4 to FIG. 6, the valve core 22 is a cylinder. The upper portion and the lower portion of the valve core 22 are moved to block the upper outlet 212 and the lower outlet 213, respectively. In the normal state, the upper portion and the lower portion of the valve core 22 are moved to block the upper outlet 212 and the lower outlet 213, respectively. When valve core 22 is moved up, the upper portion of the valve core 22 blocks the upper outlet 212 and the lower portion of the valve core 22 does not block the lower outlet 213 so that the lower outlet 213 communicates with the lateral inlet 211. When the valve core 22 is moved down, the lower portion of the valve core 22 blocks the lower outlet 213 and the upper portion of the valve core 22 does not block the upper outlet 212 so that the upper outlet 212 communicates with the lateral inlet 211. In order to ensure that the valve core 22 can completely block the upper outlet 212 and the lower outlet 213, the upper portion and the lower portion of the valve core 22 are mated with sealing members a, respectively. In order to limit the maximum downward movement distance of the valve core 22, the central portion of the valve core 22 is provided with a limiting protrusion 222 that is movably engaged with the circumferential edge of the upper end of the lower outlet 213.

As shown in FIG. 1 and FIG. 4 to FIG. 6, the linking member 4 includes a wire tube 41, a wire 42, and a reversing drive mechanism. The wire tube 41 is fixed in the shower rod 1. The wire 42 is movably inserted in the wire tube 41. An upper end of the wire 42 is connected to the valve core 22. A lower end of the wire 42 is connected to the reversing drive mechanism. The reversing drive mechanism is linked with the lead screw sleeve 323.

As shown in FIG. 1 and FIG. 4 to FIG. 6, the reversing drive mechanism includes a reversing swing block 43, a guide sleeve 44, a piston 45, a push rod 46, and a return spring 47. The guide sleeve 44 is fitted in the inlet end opening 311. The piston 45 is movably inserted into the guide sleeve 44. The reversing swing block 43 is rotatably fitted under the guide sleeve 44. The upper end of the push rod 46 is inserted into the guide sleeve 44 from the lower end of the guide sleeve 44 and is connected to the piston 45. The lower end of the push rod 46 is movable to hold one side of the reversing swing block 43. One end of the lead screw sleeve 323 is movable to hold another side of the reversing swing block 43. The return spring 47 is disposed between the push rod 46 and the guide sleeve 44 for driving the push rod 46 to move downward. Wherein, the outer wall of the guide sleeve 44 is provided with an engaging member 441 that is engaged with the circumferential edge of the lower end opening of the shower rod 1. The engaging member 441 is provided with a water hole 4411 for the passing of water. The engaging member 441 has a hinge portion 4412 extending downward. The reversing swing block 43 is hinged to the hinge portion 4412. The diameter of the piston 45 is greater than the diameter of the bottom opening of the guide sleeve 44 to confine the piston 45 within the guide sleeve 44. The push rod 46 is connected to the piston 45 by means of a screw connection. The lower end of the push rod 46 is provided with a stopping piece 461 extending outward. Two ends of the return spring 47 lean against the lower end of the guide sleeve 44 and the upper end surface of the stopping piece 461, respectively.

Figure 4:
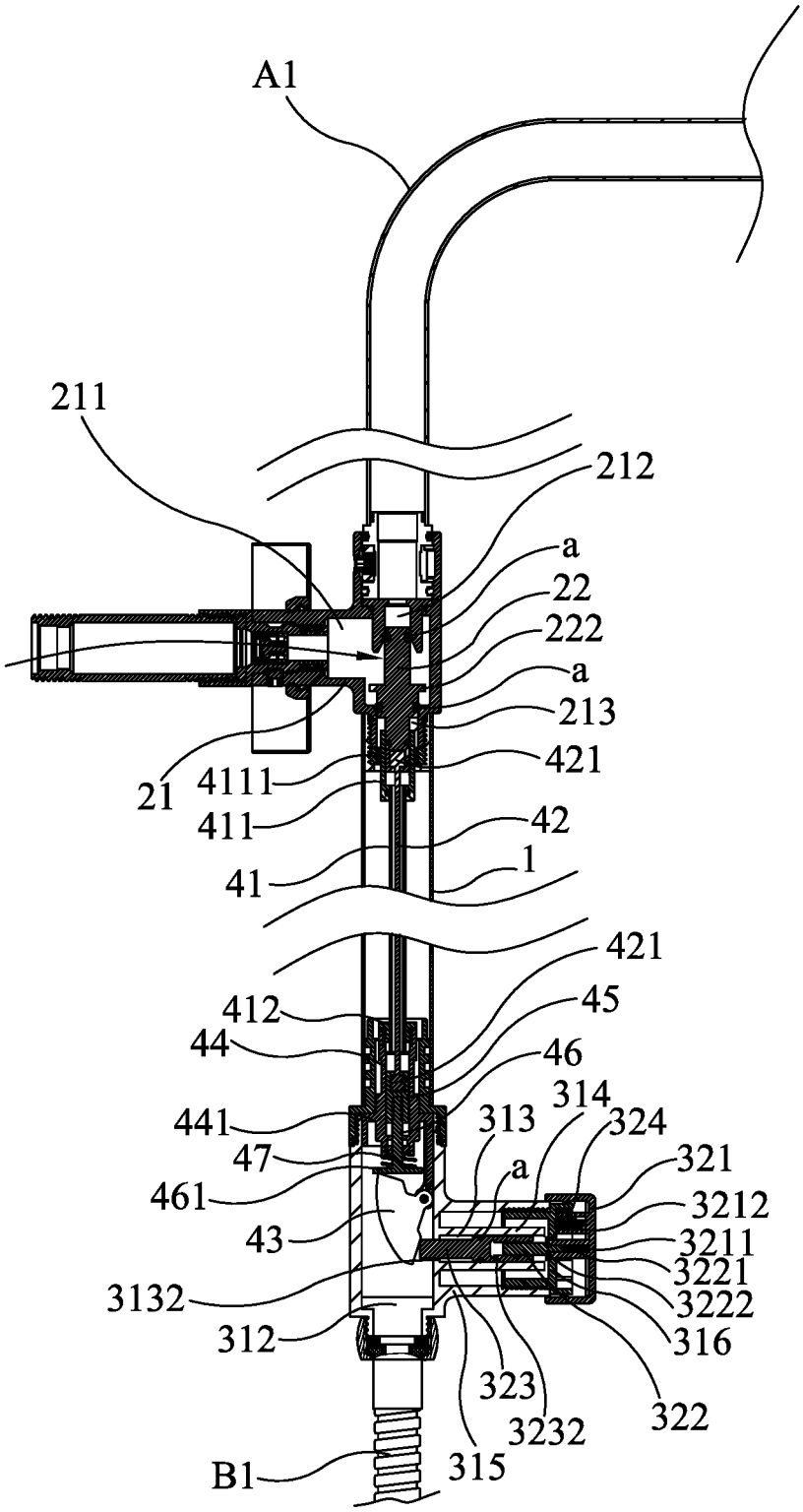
FIG. 4 is a cross-sectional view of the present invention when not in use.
Figure 5:
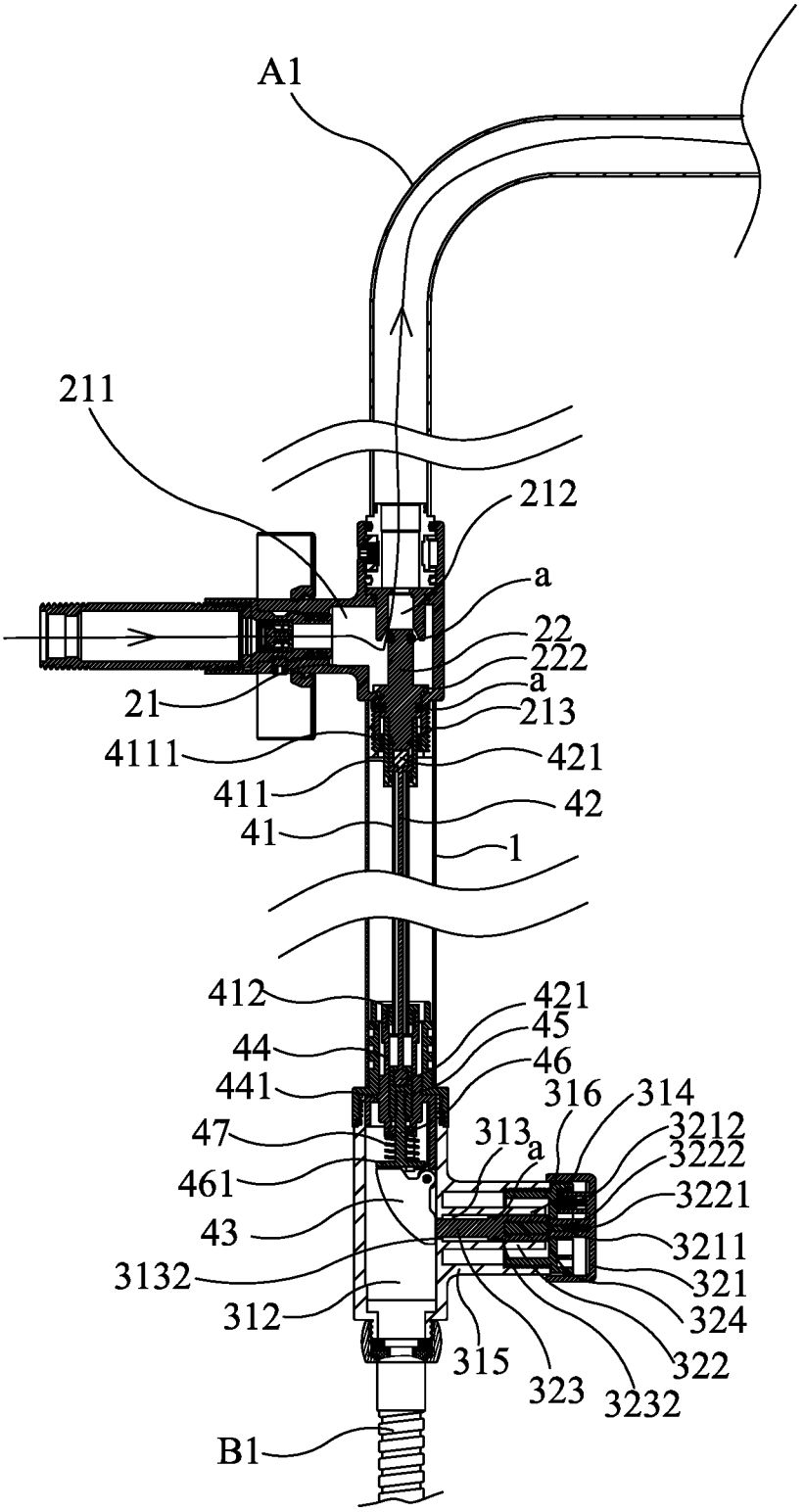
FIG. 5 is a cross-sectional view of the present invention when the shower nozzle is selected to spray water.
Figure 6:
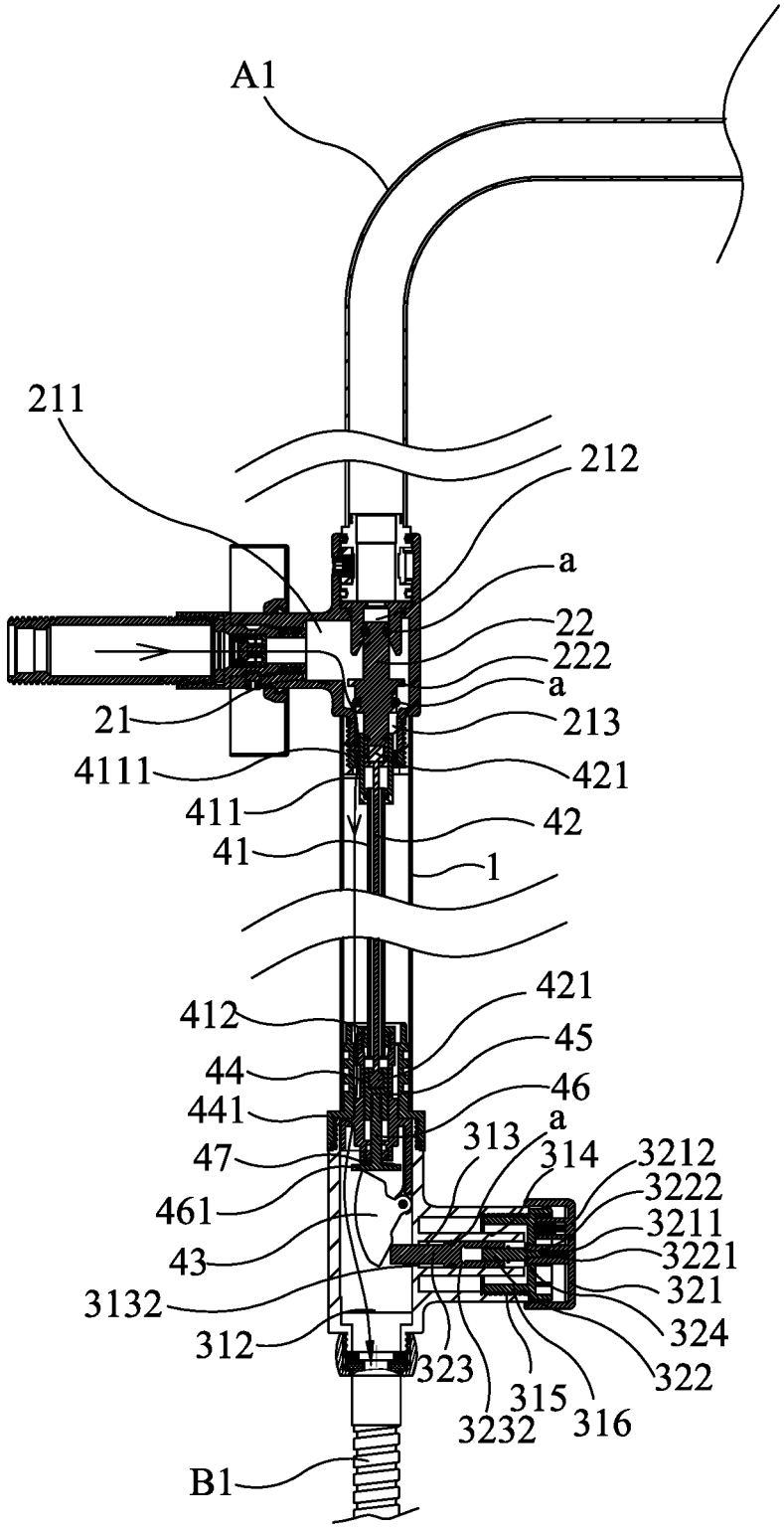
FIG. 6 is a cross-sectional view of the present invention when the hand-held shower head is selected to spray water.

As shown in FIG. 1 and FIG. 4 to FIG. 6, the upper end of the wire tube 41 is connected with a fixing sleeve 411. The outer wall of the fixing sleeve 411 is provided with a fixing flange 4111 connected to the inner wall of the shower rod 1. The fixing flange 4111 is formed with a water aperture 4112 for the passing of water. The lower end of the wire tube 41 is connected with a connecting sleeve 412. The connecting sleeve 412 is connected to the upper end opening of the guide sleeve 44. The upper and lower ends of the wire tube 41 can be fixed by the fixing sleeve 411 connected to the inner wall of the shower rod 1 and the guide sleeve 44 engaged with the circumferential edge of the lower end opening of the shower rod 1, respectively, so that the wire tube 41 is fixed in the shower rod 1 to form a limit on the wire 42 disposed in the wire tube 41. In this way, the up and down movement of the wire 42 can drive the valve core 22 to move up and down. As shown in FIG. 4 to FIG. 6, the fixing flange 4111 is connected to the inner wall of the shower rod 1 by a screw connection. The connecting sleeve 412 is connected to the upper end opening of the guide sleeve 44 by a screw connection. The fixing sleeve 411 and the connecting sleeve 412 are welded or glued to the upper and lower ends of the wire tube 41, respectively. The diameter of the central through hole 4121 of the connecting sleeve 412 is less than the diameter of the piston 45 to limit the piston 45 within the guide sleeve 44.

As shown in FIG. 1 and FIG. 4 to FIG. 6, the lower end of the valve core 22 is movably disposed in the fixing sleeve 411 and connected to the upper end of the wire 42. The lower end of the wire 42 is inserted into the guide sleeve 44 from the upper end of the guide sleeve 44 and connected to the piston 45. The upper end and the lower end of the wire 42 are provided with fixing blocks 421, respectively. The lower end of the valve core 22 is provided with a first engaging groove 221 for engaging the fixing block 421 at the upper end of the wire 42. The piston 45 is provided with a second engaging groove 451 for engaging the fixing block 421 at the lower end of the wire 42. The wire 42 may be a steel wire for the wire 42 to have a certain flexibility, so that the wire 42 can push the valve core 22 to move up.

In order to facilitate the understanding of the present invention, the working process of the present invention is explained below:

As shown in FIG. 4, in the normal state, the shower device of the present invention doesn't spray water. At this time, the valve core 22 simultaneously blocks the upper outlet 212 and the lower outlet 213. The shower nozzle A and the hand-held shower head B don't spray water. The lead screw sleeve 22 holds the reversing swing block 43, and the return spring 47 is in a compressed state.

As shown in FIG. 5, when the user selects the shower nozzle A of the shower device of the present invention to spray water, the knob 321 is rotated forward, and the knob 321 drives the lead screw 322 to rotate forward, so that the lead screw sleeve 323 moves toward the knob 321. At this time, the return spring 47 is returned to drive the push rod 46 to move downward, and the downward movement of the push rod 46 pushes the reversing swing block 43 to rotate downward and drives the piston 45 to move downward. When the piston 45 moves downward, the wire 42 and the valve core 22 are simultaneously driven to move downward, so that the valve core 22 does not block the upper outlet 212, and the upper outlet 212 communicates with the lateral inlet 211. The water from the water supply pipe enters the shower nozzle A through the lateral inlet 211 and the upper outlet 212, so that the shower nozzle A sprays water, and the hand-held shower head B does not spray water.

As shown in FIG. 6, when the user selects the hand-held shower head B of the shower device of the present invention to spray water, the knob 321 is rotated in reverse, the knob 321 drives the lead screw 322 to rotate in the reverse direction, so that the lead screw sleeve 323 moves away from the knob 321, and the lead screw sleeve 323 pushes the reversing swing block 43 to rotate upward, and the reversing swing block 43 pushes the push rod 46 and the piston 45 to move up to pull the wire 42 up, and the upward movement of the wire 42 pushes the valve core 22 upward, so that the valve core 22 does not block the lower outlet 213 and the lower outlet 213 communicates with the lateral inlet 211. At this time, the water from the water supply pipe enters the shower rod 1 via the lateral inlet 211 and the lower outlet 213, and then flows into the hand-held shower head B through the three-way member 31 and the hose B 1, so that the hand-held shower head B sprays water, and the shower nozzle A does not spray water.

In summary, by rotating the knob 321 of the operating mechanism 3, the present invention can drive the valve core 22 to move and block the upper outlet 212 or the lower outlet 213 through the lead screw assembly and the linking member 4, thereby switching the shower nozzle A or the hand-held shower head B to spray water. Since the operating mechanism 3 is connected to the lower end of the shower rod 1, the present invention can facilitate the switching of spray mods for users of different heights.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A convenient control device applied to an energy-saving shower device, comprising a shower rod, a water diverter, and an operating mechanism;

the water diverter including a three-way body and a valve core, the three-way body having a lateral inlet, an upper outlet and a lower outlet, the valve core being movably fitted in the three-way body to block the upper outlet and the lower outlet;

the shower rod being a hollow structure, an upper end of the shower rod being connected to the lower outlet of the three-way body;

the operating mechanism including a three-way member and an operating assembly, the three-way member having an inlet end opening, an outlet end opening and a mounting end opening, the operating assembly being fitted in the mounting end opening; the inlet end opening being connected to a lower end of the shower rod; the operating assembly including a lead screw assembly and a knob for driving the lead screw assembly to rotate, the lead screw assembly being linked with the water diverter through a linking member located in the shower rod.

2. The convenient control device as claimed in claim 1, wherein the lead screw assembly includes a lead screw and a lead screw sleeve; an outer wall of the lead screw sleeve and an inner wall of the mounting end opening are connected by a keyed joint connection, a first end of the lead screw sleeve is linked with the valve core through the linking member, a second end of the lead screw sleeve is threadedly connected to a first end of the lead screw, and a second end of the lead screw is connected to the knob.

3. The convenient control device as claimed in claim 2, wherein the inlet end opening is located at a top of the three-way member, a side of the three-way member is formed with an inner cylinder and an outer cylinder surrounding the inner cylinder, the inner cylinder is formed with the mounting end opening; an outer end opening of the outer cylinder is connected with a mounting cover to cover the inner cylinder, and the second end of the lead screw is inserted through the mounting cover and connected to the knob.

4. The convenient control device as claimed in claim 3, wherein the mounting cover is provided with a central through hole through which the lead screw passes, and a side wall of the lead screw is matched with a retaining ring to engage an inner end edge of the through hole.

5. The convenient control device as claimed in claim 4, wherein the inner wall of the mounting end opening is provided with a limiting flange, the outer wall of the lead screw sleeve is provided with a stopping edge that is movably engaged with the limiting flange.

6. The convenient control device as claimed in claim 5, wherein a sealing member is provided between the stopping edge and the inner wall of the mounting end opening.

7. The convenient control device as claimed in claim 3, wherein a positioning mechanism is provided between the knob and the mounting cover, the positioning mechanism includes at least two recesses disposed on the mounting cover and an elastic pin disposed on the knob, and the elastic pin is movably engaged with one of the recesses.

8. The convenient control device as claimed in claim 3, wherein the inner wall of the mounting end opening is provided with a limiting keyway, and the outer wall of the lead screw sleeve is provided with a limiting key which is inserted into the limiting keyway.

9. The convenient control device as claimed in claim 3, wherein the linking member includes a wire tube, a wire, and a reversing drive mechanism;

the reversing drive mechanism includes a reversing swing block, a guide sleeve, a piston, a push rod, and a return spring; the guide sleeve is fitted in the inlet end opening, the piston is movably disposed in the guide sleeve, the reversing swing block is rotatably fitted under the guide sleeve, an upper end of the push rod is inserted into the guide sleeve from a lower end of the guide sleeve and connected to the piston, a lower end of the push rod is movable to hold one side of the reversing swing block, the first end of the lead screw sleeve is movable to hold another side of the reversing swing block; the lower end of the push rod is provided with a stopping piece extending outward, two ends of the return spring lean against the lower end of the guide sleeve and an upper end surface of the stopping piece respectively;

the wire tube is fixed in the shower rod, a lower end of the wire tube is connected to an upper end of the guide sleeve;

the wire is movably disposed in the wire tube, an upper end of the wire is connected to the valve core, and a lower end of the wire is inserted in the guide sleeve from the upper end of the guide sleeve and connected to the piston.

10. The convenient control device as claimed in claim 9, wherein an upper end of the wire tube is connected with a fixing sleeve, an outer wall of the fixing sleeve is provided with a fixing flange connected to an inner wall of the shower rod, the fixing flange is formed with a water aperture; an outer wall of the guide sleeve is provided with an engaging member that is engaged with a circumferential edge of a lower end opening of the shower rod, and the engaging member is provided with a water hole.

11. The convenient control device as claimed in claim 10, wherein the wire is a steel wire.

12. The convenient control device as claimed in claim 10, wherein the engaging member has a hinge portion extending downward, and the reversing swing block is hinged to the hinge portion.

13. The convenient control device as claimed in claim 9, wherein the valve core is a cylinder, and a lower end of the valve core is movably inserted into the fixing sleeve and connected to the upper end of the wire.

14. The convenient control device as claimed in claim 13, wherein the upper end and the lower end of the wire are provided with fixing blocks respectively, the lower end of the valve core is provided with a first engaging groove for engaging the fixing block at the upper end of the wire, and the piston is provided with a second engaging groove for engaging the fixing block at the lower end of the wire.

15. The convenient control device as claimed in claim 13, wherein a central portion of the valve core is provided with a limiting protrusion that is movably engaged with a circumferential edge of an upper end of the lower outlet.

* * * * *